US011087594B2

(12) United States Patent
Rath

(10) Patent No.: US 11,087,594 B2
(45) Date of Patent: Aug. 10, 2021

(54) GAMING ENVIRONMENTS PROVIDING RISK-ASSESSABLE FEATURE TERMINATION AND AWARD GROUPINGS

(71) Applicant: KING SHOW GAMES, INC., Minnetonka, MN (US)

(72) Inventor: Anthony Rath, St. Louis Park, MN (US)

( * ) Notice: Subject to any disclaimer, the term of this patent is extended or adjusted under 35 U.S.C. 154(b) by 0 days.

(21) Appl. No.: 16/571,713

(22) Filed: Sep. 16, 2019

(65) Prior Publication Data

US 2020/0105104 A1 Apr. 2, 2020

Related U.S. Application Data

(60) Provisional application No. 62/739,316, filed on Sep. 30, 2018.

(51) Int. Cl.
*G07F 17/32* (2006.01)
*G07F 17/34* (2006.01)

(52) U.S. Cl.
CPC ..... *G07F 17/3267* (2013.01); *G07F 17/3244* (2013.01); *G07F 17/34* (2013.01)

(58) Field of Classification Search
None
See application file for complete search history.

(56) References Cited

U.S. PATENT DOCUMENTS 6,217,448 B1 * 4/2001 Olsen ..... G07F 17/32 463/25
7,361,088 B2 * 4/2008 Maya ..... G07F 17/32 463/16
8,408,990 B2 * 4/2013 De Waal ..... G06F 19/00 463/20
10,769,891 B2 * 9/2020 Berman ..... G07F 17/3262
2004/0077403 A1 * 4/2004 Maya ..... G07F 17/32 463/20
2004/0116174 A1 * 6/2004 Baerlocher ..... G07F 17/34 463/16
2008/0113771 A1 * 5/2008 Baerlocher ..... G07F 17/32 463/25
2009/0124326 A1 * 5/2009 Caputo ..... G07F 17/3244 463/20
2010/0124971 A1 * 5/2010 Baerlocher ..... G07F 17/3258 463/20
2011/0045898 A1 * 2/2011 Anderson ..... G07F 17/3267 463/25
2011/0124402 A1 * 5/2011 De Waal ..... G07F 17/3267 463/25
2013/0130770 A1 * 5/2013 Oles ..... G07F 17/3267 463/20

(Continued)

*Primary Examiner* — Seng H Lim

(57) ABSTRACT

Gaming environments including gaming systems, apparatuses, and methods facilitate player selection of feature termination versus award groupings, where at least some of such termination/award groupings are associated with a likelihood of success of the feature continuing beyond the current player selection, depending on how the player makes selections. The player selects award groupings having potential ranges of multiple game-related characteristics, where at least one of those game-related characteristics impacts the likelihood of success of continued play of the gaming feature.

12 Claims, 12 Drawing Sheets

(56) References Cited

U.S. PATENT DOCUMENTS

| | | | | |
|---|---|---|---|---|
| 2015/0356829 | A1* | 12/2015 | Caputo | A63F 13/77 463/16 |
| 2016/0093162 | A1* | 3/2016 | Marston | G07F 17/3267 463/25 |
| 2016/0321857 | A1* | 11/2016 | Meyer | G07F 17/326 |
| 2017/0309125 | A1* | 10/2017 | Moody | G07F 17/3267 |
| 2018/0025589 | A1* | 1/2018 | Luong | G07F 17/3213 463/20 |
| 2018/0130304 | A1* | 5/2018 | Berman | G07F 17/3213 |
| 2018/0130305 | A1* | 5/2018 | Berman | G07F 17/3213 |
| 2019/0051096 | A1* | 2/2019 | San | G07F 17/3267 |
| 2019/0362599 | A1* | 11/2019 | Wodarz | G07F 17/3262 |

* cited by examiner

GAMING ENVIRONMENTS PROVIDING RISK-ASSESSABLE FEATURE TERMINATION AND AWARD GROUPINGS

FIELD

This disclosure relates generally to games, and more particularly to systems, apparatuses and methods for providing enhanced awards in gaming environments.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to provide enhanced awards in gaming environments.

In accordance with one embodiment, a game apparatus is provided for enhancing gaming awards in a gaming activity. The game apparatus includes a display, a user interface with user inputs to enable players to initiate the gaming activity and to participate in a bonus event, a wager input device structured to identify and validate player assets and to permit the player to play bonus event when the player assets are provided, and a processor. The processor is configured to enable player selection of an award group including a range of award values and a range of modifier values, among a plurality of such award groups. The processor is further configured to randomly identify an award value from the range of award values, and randomly identify a modifier value from the range of modifier values, from the award group selected by the player. The processor is further configured to add the randomly identified modifier value to an accumulated modifier bank, and to enhance the randomly identified award value with the randomly identified modifier value and award the resulting value to the player, if the addition of the randomly identified modifier value did not exceed a threshold of the accumulated modifier bank.

In a more particular embodiment, as long as the threshold of the accumulated modifier bank is not exceeded, the player is to continue with the selection of award groups, and the processor continues to randomly identify award values and modifier values from the award group selected by the player; add the randomly identified modifier value to an accumulated modifier bank and enhance the randomly identified award value with the randomly identified modifier value and award the resulting value to the player. Otherwise, if the threshold is exceeded, participation in the bonus event terminates.

In another particular embodiment, the processor is further configured to associate different pairings of the range of award values and the range of modifier values with each of the award groups. In a more particular embodiment, the processor calculates a likelihood of a potential one of the identified modifier values from the range of modifier values, wherein yet another embodiment an indication of the calculated likelihood is presented to the player via the display.

In another embodiment of such a game apparatus, the range of modifier values involves a range of multiplier values, and the randomly identified modifier value involves a multiplier value. The processor enhances the randomly identified award value by multiplying the multiplier value times the randomly identified award value.

In accordance with another embodiment, a slot game apparatus is provided for facilitating participation in a repeatable award-generating segment of a gaming feature. The slot game apparatus includes a display, a user interface including at least one user input to enable a player to interact with the gaming feature, a wager input device structured to identify and validate player assets and to permit the player to participate in the gaming feature when the player assets are provided, and a processor. The processor is configured to create selectable groups, each including an award range and an award modifier advancement range. The processor is further configured to provide an award modifier level to maintain a running total of award modifier advancements from player-selected ones of the selectable groups, and providing a threshold level with the award modifier level. The processor is further configured to determine probabilities, for each of the selectable groups, that award modifier advancements from each of the respective award modifier advancement ranges would cause the threshold level to be reached if the respective one of the selectable groups was selected by the player. Players are allowed to select one of the selectable groups, and the processor identifies an award from the award range, and an award modifier advancement from the award modifier advancement range, of the player-selected group. The processor is further configured to add the award modifier advancement to the award modifier level to update the award modifier level, and if the threshold level of the award modifier level is not exceeded, to enhance the identified award with a modifier corresponding to the award modifier level to provide a payout, and award the payout to the player. The processor further enables continued player selections of one of the selectable groups, and award the payouts to the player, until the threshold level of the award modifier level is exceeded.

In a more particular embodiment of such a slot game apparatus, the processor is configured to enable continued player selections of one of the selectable groups and award the payouts to the player, by facilitating the player selection, identifying the award and the award modifier advancement, adding the award modifier advancement to the award modifier to update the award modifier level, enhance the identified award with the modifier, and award the payout to the player, until the threshold level of the award modifier level has been exceeded as a result of adding the award modifier to the award modifier level.

In yet another embodiment of such an apparatus, the processor is configured to add the award modifier advancement to the award modifier level before the processor enhances the identified award with the modifier corresponding to the award modifier level to provide the payout, where in still another embodiment the processor is configured to add the award modifier advancement to the award modifier level after the processor enhances the identified award with the modifier corresponding to the award modifier level to provide the payout.

In accordance with another embodiment, a game apparatus is provided for facilitating participation in a repeatable award-generating segment of a gaming feature. The game apparatus includes a display, a user interface having user inputs to allow a player to interact with the gaming feature, a wager input device structured to identify and validate player assets and permit the player to participate in the gaming feature when the player assets are provided, and a processor. The processor is configured to create a plurality of selectable groups, each comprising an award range and a multiplier advancement range, provide a multiplier aggregation storage to maintain a running total of multiplier advancements from player-selected ones of the selectable groups, and provide a threshold level with the multiplier aggregation storage. The processor is further configured to determine probabilities, for each of the selectable groups, that multiplier advancements from each of the respective multiplier advancement ranges would cause the threshold level to be reached if the respective one of the selectable groups was selected by the player. The processor is further configured to facilitate player selection of one of the selectable groups, and to identify an award from the award range, and a multiplier advancement from the multiplier advancement range, of the player-selected one of the selectable groups. The processor is further configured to add the multiplier advancement to the multiplier aggregation storage to update the multiplier aggregation storage. If the threshold level of the multiplier aggregation storage is not exceeded, the processor enhances the identified award with a multiplier corresponding to a current accumulated value in the multiplier aggregation storage to provide a payout, and award the payout to the player. The processor is further configured to enable continued player selections of one of the selectable groups, and award the payouts to the player, until the threshold level of the multiplier aggregation storage is exceeded.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
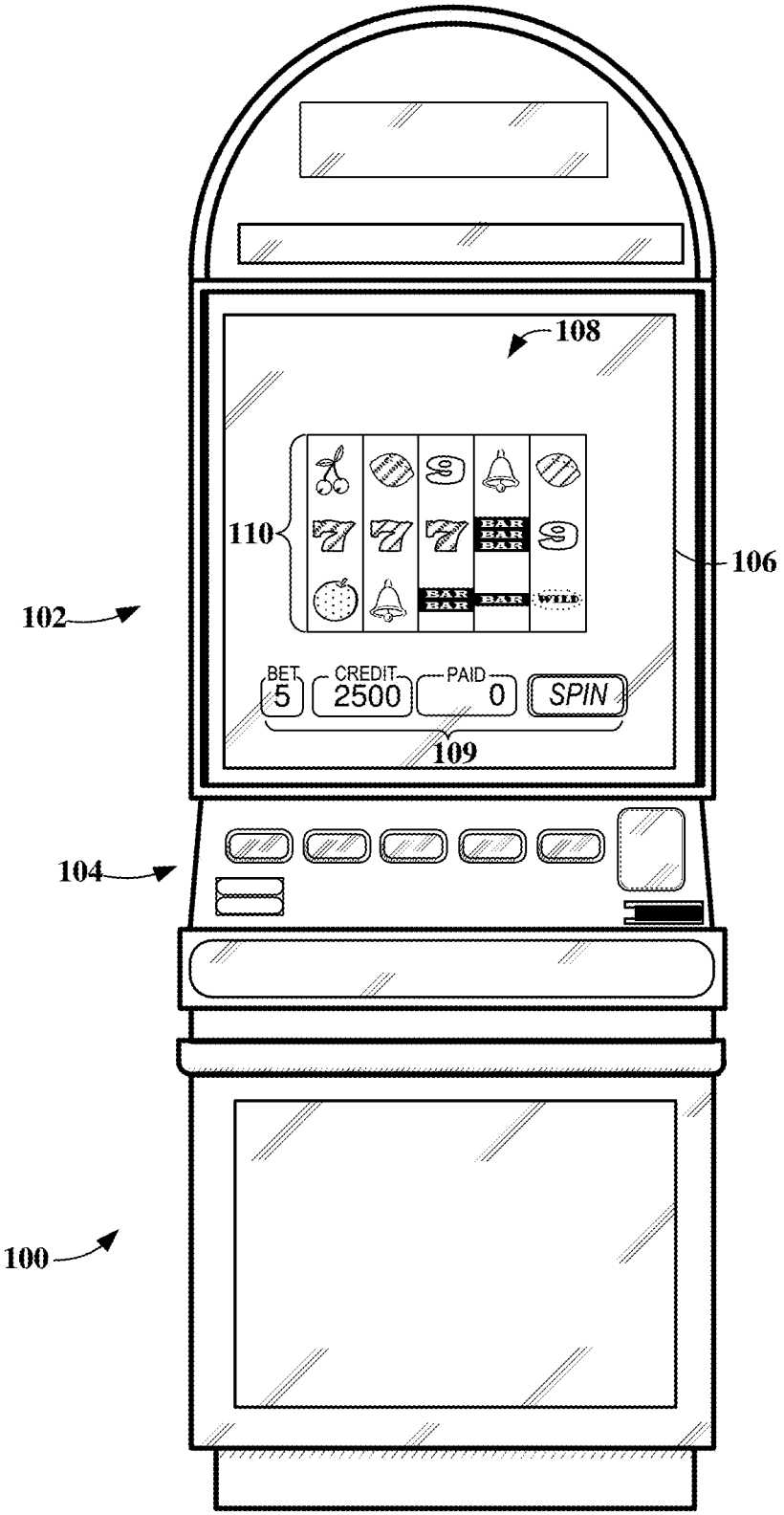
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels,"

"hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing awards in gaming environments. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves facilitating player selection of feature termination versus award groupings, where at least some of such termination/award groupings are associated with a likelihood or odds of success or failure of the feature continuing beyond the current player selection.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
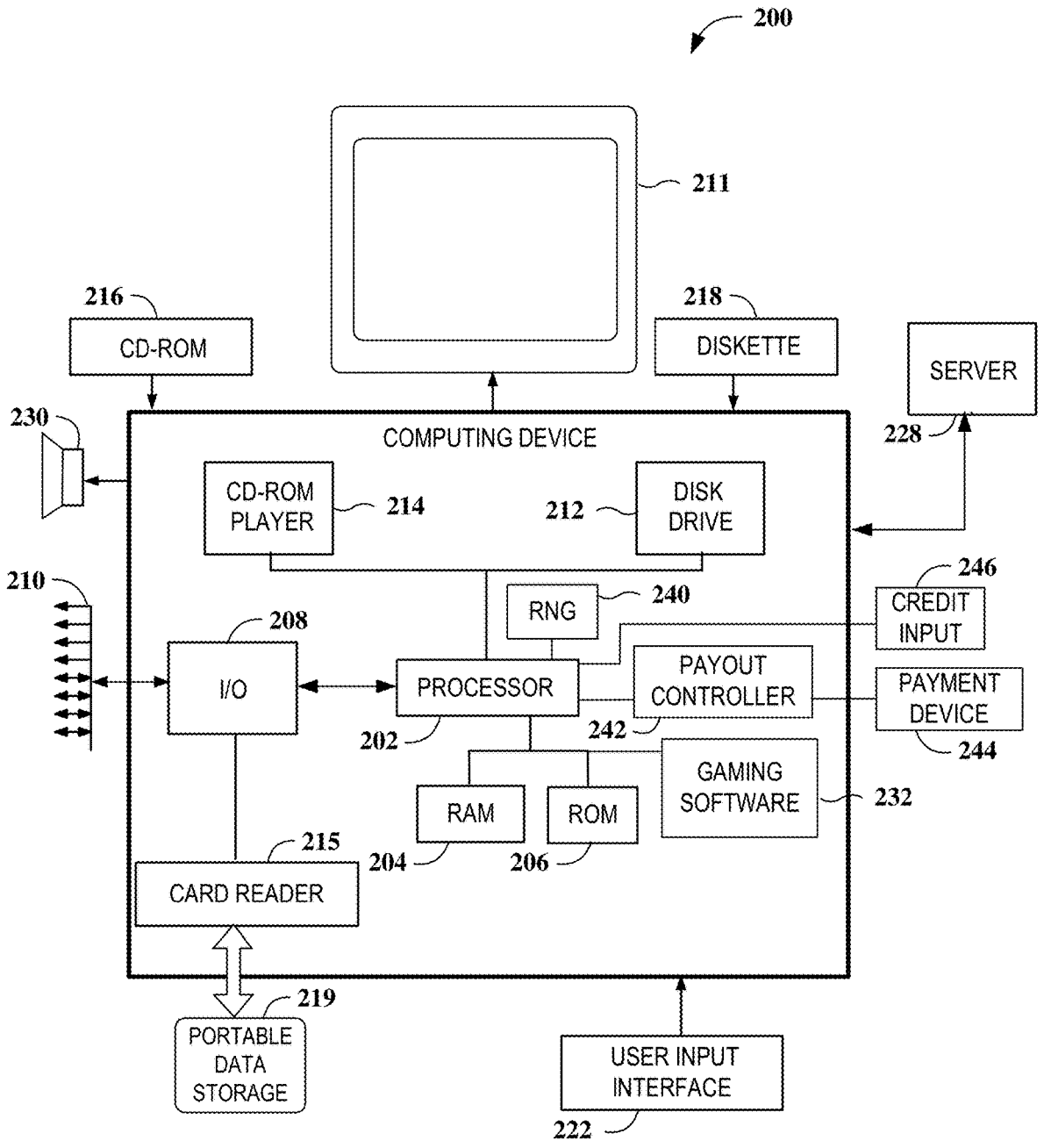
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, gaming environments including gaming systems, apparatuses, and methods facilitate player selection of feature termination versus award groupings, where at least some of such termination/award groupings are associated with a likelihood or odds of success or failure of the feature continuing beyond the current player selection.

In this manner, a player may select (and/or the system may automatically select in response to some input(s) or other game events/criteria) an award or award range understanding at least something about the risk of ending the gaming feature as a result of the selection.

In one embodiment, the likelihood of success of continuing participation in the feature as a result of a current selection is based on another variable associated with the selection, different from the award or award range, such as an award modifier. For example, random award modifiers, within a revealed potential modifier range or left hidden from the player, may be aggregated upon successive selections. In such an embodiment, the feature may end when the aggregated award modifier reaches a predetermined threshold, a random threshold, a game-dependent threshold (e.g., based on credits played, results, etc.) as a result of the player selections. In some embodiments, the potential credit award range of a selected award is at least somewhat proportional to the modifier or other variable that could cause the threshold to be met, thereby ending the award-generating feature. As a more particular example, a player may be presented with an opportunity to select between, for example: (1) a potential credit award having a range of 100-300 credits with a potential variable (e.g., multiplier) having a range of 0-2, and (2) a potential credit award having a range of 600-1000 credits with a potential variable (e.g., multiplier) having a range of 1-5. If a variable/multiplier threshold is set to 6, and the current variable/multiplier level is 3, then if the player selects option (1), even if the randomly granted award results in 2 (i.e. within the range of 0-2 in this example), the most that the current variable/multiplier would rise to is 5 (i.e. current level of 3 plus the granted result of 2), and thus the threshold of 6 would not be reached and the feature would not yet end. Alternatively, had the player selected option (2) and received, for example, a credit award of 700 (within the range of 600-1000) and a variable/multiplier of 4, then the current variable/multiplier level would exceed the threshold of 6 (i.e. current level of 3 plus the granted result of 4), thereby ending the feature. In some embodiments, the final credit award, that was obtained with a selection that causes the variable/multiplier feature to exceed the threshold, may be paid to the player, with or without being enhanced by a current multiplier or other modifier, while in other embodiments no further award or payout is provided if the associated variable/multiplier causes the threshold to be exceeded.

In one embodiment, groupings of available credit ranges and available multiplier ranges are made available to the user for selection. For example, a first grouping may include a first range of potential credit awards (e.g., 10-50 credits) and a first range of multiplier awards (e.g., 1×-2× multiplier, or 0×-2× multiplier increase, etc.). A second grouping may include a second range of potential credit awards (e.g., 60-100 credits) and a second range of multiplier awards (e.g., 1×-3× multiplier, or 0×-3× multiplier increase, etc.), and so forth for as many groupings as desired. In some embodiments, the grouping selection is based on a set credit amount versus a random amount within a range, and/or based on a set modifier amount versus a random amount within a range. In this particular example, a current value of the award modifier is maintained, and newly awarded modifiers provided in connection with a player-selected grouping increases the current value of the award modifier to be applied to current and/or subsequent credit awards, thereby providing an accumulated and augmentable current modifier. In one embodiment, if the selected modifier causes the current modifier to exceed a threshold, the gaming feature ends, thereby ending further chances to obtain additional credit awards and/or other awards. A success rate or other risk identifier may be placed on each selectable grouping, to enable the player to conduct a risk analysis whereby, in one embodiment, potentially higher awards correspond to potentially higher modifier values, thereby providing a potentially higher granted award with a higher risk of ending the gaming feature.

A modifier as used herein may include any value that may be used mathematically to enhance or otherwise change another value(s). For example, a modifier may be a multiplier that is multiplied by a second value to enhance that second value. In another example, a modifier may be used as an exponent to a second value to enhance that second value. Modifiers may also be added to a second value to enhance that second value. Thus, a modifier represents anything that can be mathematically applied to one or more other numbers, values, prizes, or other asset to increase or otherwise enhance those other numbers, values, prizes, or other assets.

The above examples merely represent representative embodiments of the principles provided herein. Numerous other embodiments, variations and teachings are provided herein, as set forth in the description herein and accompanying drawings.

Many embodiments may be described in terms of a slot game, where symbols are matched on paylines, in quantities or otherwise defined to determine payout awards. However, the principles described herein are equally applicable to other games of chance, as described herein and as will be readily apparent to those skilled in the art from the teachings herein. For example, in a "bonus" event or other feature of a game implementing the principles described herein, the base game may be any game including slots, poker, bingo, roulette, keno, etc.

Figure 3A:
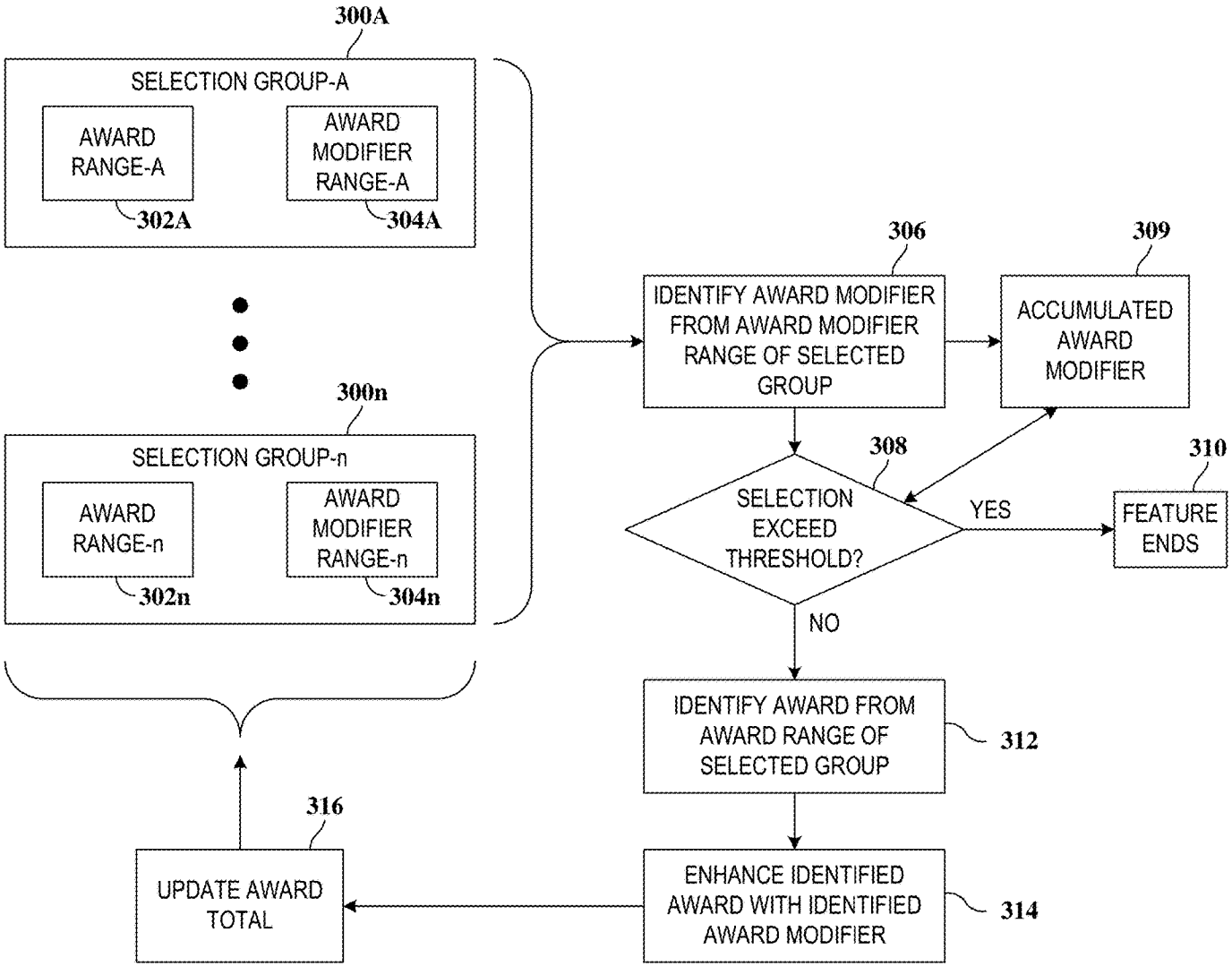
FIG. 3A depicts an embodiment for facilitating player selection of groups of payout-related gaming characteristics, such as credit awards and payout modifiers.

FIG. 3A illustrates an embodiment for facilitating selection of one or more groups of payout-related gaming characteristics, such as credit awards and payout modifiers, in accordance with the principles described herein. In some embodiments, the player is presented with information enabling the player to make a risk analysis related to the strength and/or size of the award versus the relative likelihood of that choice causing the award-generating feature to conclude.

FIG. 3A is described in connection with a flow diagram in which a gaming system or apparatus can be operated according to the representative embodiment. Similarly, other flow diagrams are provided in this disclosure that represent various representative manners in which a gaming apparatus/system can be operated according to their respective embodiments. Although various processes may be shown in particular orders in such flow diagrams, the order of operation can be changed in other embodiments without deviating from the scope or spirit of this concept. Accordingly, the order of operations shown is for illustrative purposes only and is not meant to be restrictive. Additional game processes may also be included between various processes even though they are not shown, for clarity purposes, in these flow diagrams. Each of the processes or operations may be performed by components in a single game device, such as by a game processor(s), may be performed in part or whole by a remote server(s), processor(s) connected to the gaming device via a network, etc. Each operation or process may be encoded in instructions that are stored in one or more memories, computer-readable medium(s), and/or another type of storage device(s). The representative methodologies depict representative embodiments of how game operations may be implemented. As discussed herein, many variations exist which may require additional, fewer, or different operations to complete.

As depicted in the embodiment of FIG. 3A, a plurality of selectable groups 300A-300*n* are depicted, which include one or more payout-related gaming characteristics. The selectable groups are depicted as selection group-A 300A through selection group-n 300*n*. The one or more of the selectable groups 300A-300*n* may include a single payout-related gaming characteristic up to any desired number of gaming characteristics. In the illustrated embodiment, each of the selection groups 300A-300*n* includes at least two such payout-related gaming characteristics, namely credit or other payout awards, and credit/payout modifiers. For example, the representative selection group-A 300A includes an award range-A 302A of potential credit awards, and an award modifier range-A 304A of potential award modifiers (e.g., multiplier). Similarly, representative selection group-n 300*n* includes an award range-n 302*n* of potential credit awards, and an award modifier range-n 304*n* of potential award modifiers. Any greater or lesser number of payout-related gaming characteristics, and/or different payout-related gaming characteristics, may be implemented. Further, in other embodiments, one or more of the payout-related gaming characteristics may be single values rather than ranges of potential values as described in this and other embodiments herein, as the principles apply equally thereto.

In accordance with one embodiment, a decision on which group 300A-300*n* may be based on probability information, or other desired information associated with the particular game or feature being played. For example, the decision may be based on probability information, such as the likelihood of avoiding termination of the played feature depending on which of the groups 300A-300*n* are selected. For example, one embodiment allows modifiers to accumulate upon each successive selection, and when the modifier reaches a threshold value, participation in the feature ends. Thus, the player may hope to allow the feature to continue to be played by making decisions as to which of the selectable groups 300A-300*n* should be selected.

In the embodiment of FIG. 3A, upon selection of one of the groups 300A-300*n*, an award modifier is identified 306 from the award modifier range of the selected group. For example, if the player selected the group-A 300A that includes a range of award modifiers depicted as the award modifier range-A 304A, then at least one modifier may be randomly or otherwise identified 306 by the gaming system as an available modifier for that selection. As a more particular example, the award modifier range-A 304A may represent a multiplier range of 1×-2×, meaning that the identified 306 multiplier may be used to increase a previous, current, or subsequent credit award by the identified amount (e.g., 1× would cause the credit value to remain the same, while 2× would double a credit value). In other embodiments, the identified 306 multiplier or other modifier may represent an amount to be added to a cumulative modifier (e.g., 0× would not increase the cumulative multiplier total; 1× would increase it by one, etc., whereby the cumulative multiplier total may be used to enhance credit awards).

Where such a threshold is present, it is determined 308 whether the identified 306 award modifier exceeds that threshold. It should be recognized that threshold can be set to a number, and "exceeds" may also represent "meets or exceeds" depending on how the threshold is set. Therefore, the representative embodiment FIG. 3A involving "exceeding" a threshold is not limited thereto, as reaching a threshold or coming within some amount of the threshold is equally contemplated by the description herein. Further, any manner of determining whether the identified 306 award modifier exceeds the threshold. For example, the processor may be configured to compare the identified award modifier 306 with a threshold award modifier.

In one embodiment, the threshold is maintained and increased with further identifications 306 of award modifiers. For example, if an original award modifier is set to 1× (i.e. no enhancement as 1 times a credit value equals the credit value), then further identifications 306 of award modifiers are accumulated into an accumulated award modifier 309, in which the accumulation may ultimately reach the threshold. Such determination may be accomplished, in one embodiment, by hardware, a programmed processor, or other configured hardware to compare the identified award modifier 306 to a current state of the accumulated award modifier 309.

In one embodiment, if the threshold is exceeded, the feature ends 310. Otherwise, the feature continues, and an award is identified 312 from the award range-A 302A of the selected group-A 300A. For example, if the award range-A 302A identified a credit range of 200 credits to 400 credits, a particular credit award from that range is identified 312 (e.g., 250 credits, or 300 credits, etc.). In one embodiment, identification 306, 312 from their respective ranges 302A, 304A are randomly selected, while in other embodiments other criteria may establish or otherwise weight the results in a particular manner.

The identified 312 award may be enhanced 314 by the identified 306 award modifier. For example, if the identified award was 250 credits, and the identified award modifier was a 2× multiplier, enhancing 314 the identified award with the identified award modifier would result in a total award of 500 credits in the example. In other embodiments, the award that is enhanced 314 may be some other credit value, such as an accumulated credit value, or some other award. Kate some enhancement 314, and award total may be updated 316. In this embodiment, since the feature is not end 312, the player is allowed to select another group 300A-300*n* in a further attempt to win enhanced payout awards.

Figure 3B:
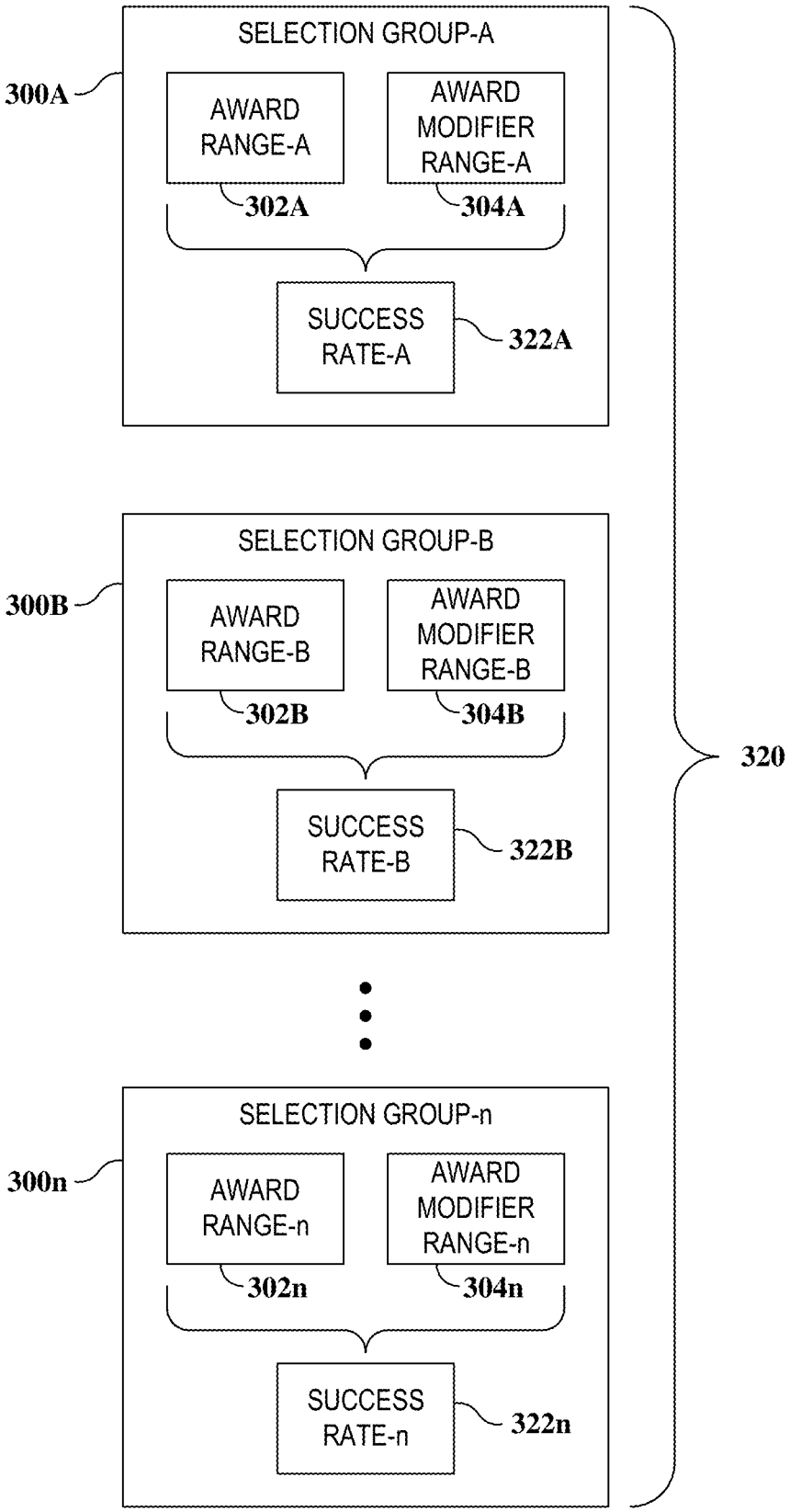
FIG. 3B depicts an embodiment where likelihood-of-success information is calculated and presented to the player to assist with group selection decisions.

As noted above, some embodiments enable probability or "success" information to be calculated and presented to the player to assist with the decision as to which group 300A-300*n* to select. For example, the decision may be based on probability information, such as the likelihood of avoiding termination of the played feature, or alternatively stated the chances of success of continued play. FIG. 3B depicts an embodiment where such probability or "success rate" is calculated and made available to the player.

More particularly, the embodiment of FIG. 3B depicts a plurality of selection groups 320, using common reference numbers to those in FIG. 3A where applicable. Selection group-A 300A includes the previously-described award range-A 302A and award modifier range-A 304A, selection group-B 300B includes award range-B 302B and award modifier range-B 304B, and selection group-n 300*n* includes the previously-described award range-n 302*n* and award modifier range-n 304*n*.

Additionally, each of the various groups 300A, 300B, 300*n* includes a success rate 322A, 322B, 322*n* respectively. Each of these success rates represents the likelihood, of an ultimately identified 306 award modifier of the selected group, staying below the feature-ending threshold of the accumulated award modifiers. In other embodiments, the success rate may be based on other gaming characteristics, such as the likelihood of identified 312 credit values being at a particular point relative to a threshold, or the like. In the illustrated embodiment, it is assumed, for purposes of facilitating an understanding of a representative success rate calculation and indication, that the success rates represent the likelihood of an ultimately identified 306 award modifier staying below the feature-ending threshold of the accumulated award modifiers.

The success rate-A 322A thus represents the likelihood of the identified 306 award modifier from the award modifier range-A 304A causing the accumulated award modifier 309 to stay below the established accumulated modifier threshold, if the player selects selection group-A 300A. Similarly, the success rate-B 322B thus represents the likelihood of the identified 306 award modifier from the award modifier range-B 304B causing the accumulated award modifier 309 to stay below the established accumulated modifier threshold, if the player selects selection group-B 300B, and so forth.

For example, where the award modifier range-A 304A is a lesser range than that of, for example, award modifier range-B 304B, and an accumulated award modifier 309 threshold exists, it is more likely that an award modifier selected from the modifier range-B 304B will cause the accumulated award modifier 309 to exceed the threshold, thereby causing the gaming feature to end. In one embodiment, the set of award ranges 302A, 302B, 302*n*) and award modifier ranges 304A, 304B, 304C from their respective selection group 300A, 300B, 300*n* may exhibit higher potential payouts, but with a higher risk of ending the gaming feature. Therefore, a player may take a higher risk of the feature ending in return for a potentially higher credit award and/or award modifier. Alternatively, a player may opt to select a selection group that has a lower risk of the feature ending, by accepting lower awards and/or award modifiers. Additional embodiments describing such probabilities and/or success rates are described below.

Figure 4A:
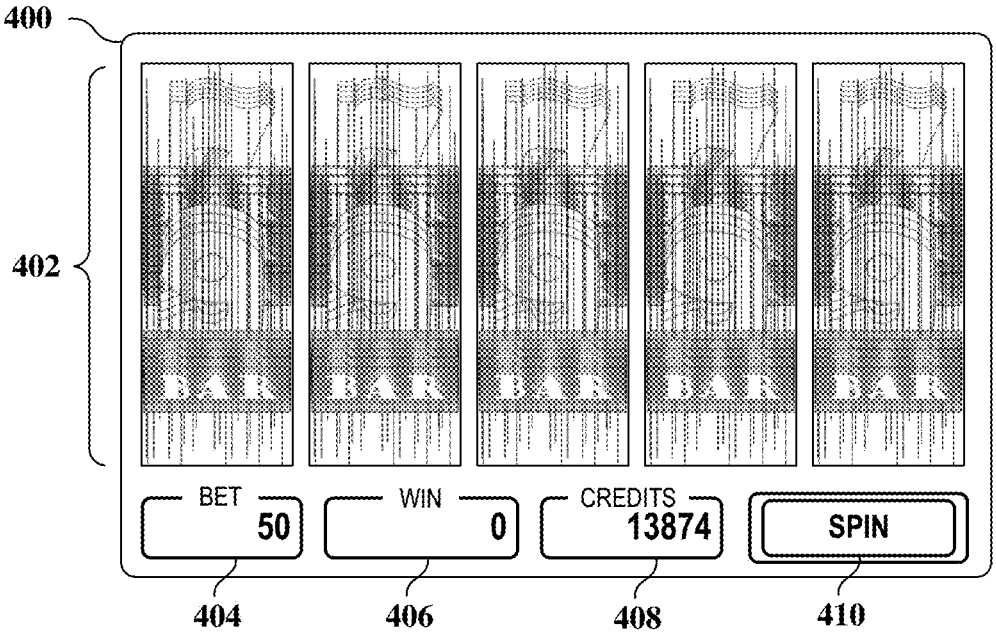
FIGS. 4A-4B are diagrams of a gaming display 400 showing a representative slot game in which a bonus event or gaming feature as described herein may be played.
Figure 4B:
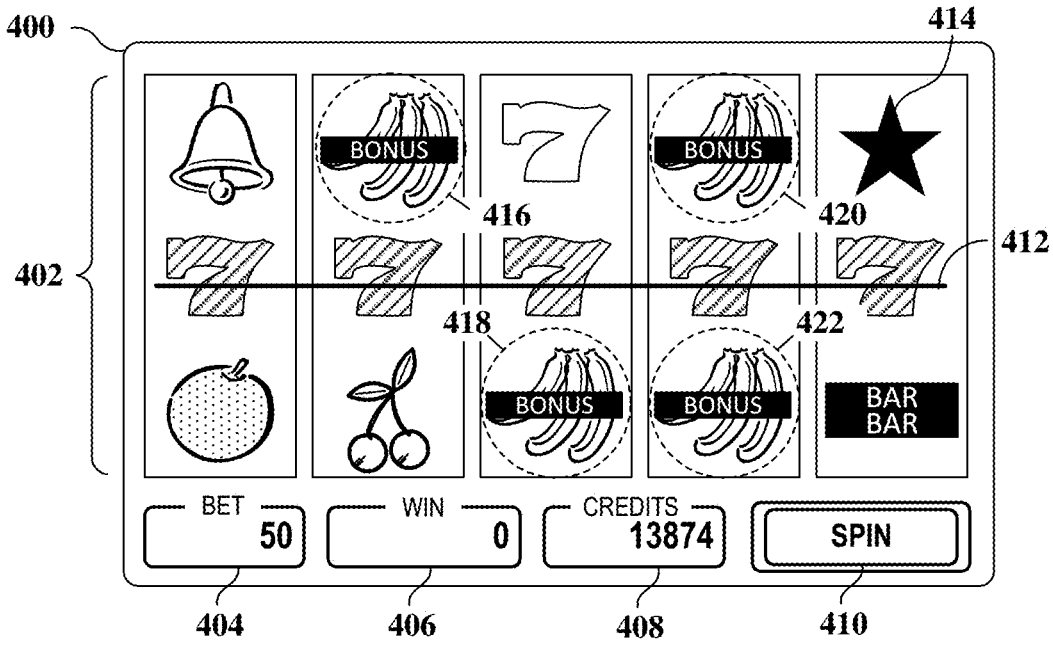

FIGS. 4A-4B are diagrams of a gaming display 400 showing a representative slot game in which a bonus event or gaming feature as described herein may be played. While the gaming features described in this disclosure may be used in any gaming situation, including as a primary game in and of itself, various embodiments herein are described in terms of a bonus event or gaming feature merely for purposes of example. FIG. 4A depicts a gaming display 400 that includes a game grid 402 having, for example, five game reels each having multiple game symbols. In other embodiments, each symbol location or cell may individually "spin" or otherwise randomize the symbol to be presented therein. A player interface portion may include meters, interactive buttons and the like, such as bet meter 404, win meter 406 showing payouts, a total credits meter 408, and a spin button 410. The game grid 402 is depicted in FIG. 4A in a spinning state where symbols are randomized for presentation.

FIG. 4B shows the game grid 402 after completion of a reel spin. Symbols are shown to populate the various reels of the game grid 402. A bonus event or other gaming feature may be initiated in any desired manner, including but not limited to a series of symbols on a payline(s) 412, and/or a special symbol 414, and/or a plurality of special symbols 416, 418, 420, 422 presented anywhere on the grid 402 or with some position requirements, or the like. In one embodiment, presentation of a certain number or more special symbols 416, 418, 420, 422 (e.g., three or more such symbols) presented anywhere on the grid 402 initiates a bonus event, where the number of such symbols presented on the grid 402 impacts a level of subsequent award possibilities, as described in other embodiments below. The gaming features described herein may be invoked in any desired manner, including any of those representative manners described in connection with FIG. 4B.

In addition to being a bonus event or other derivative gaming feature, the principles described herein are equally applicable as a primary game. Whether invoked as a bonus event, primary event, or otherwise, FIGS. 5A-5L depict one representative manner for facilitating participation in a state-based, award-generating feature involving successive player selection of groups of payout-related gaming characteristics to obtain awards and extend a payout modifier or enhancement state, whereby the risk of ending the feature and enhancement state are weighed against at least one other characteristic (e.g., potential awarded credit range) in the group selection decision. The example of FIGS. 5A-5L illustrates an embodiment of a representative game play progression to facilitate an understanding of some principles and/or variations described herein, and therefore the example of FIGS. 5A-5L should not be limiting to the broader concepts and disclosure provided herein. In the illustrated embodiment of FIGS. 5A-5L, the representative gaming feature is described in an electronic embodiment, involving an electronic display(s) 500 or portions thereof. Thus, references to a display represent any display unit(s), portion(s) of such display unit(s), other electronic game presentation mechanisms, mechanical/physical embodiments, etc.

Figure 5A:
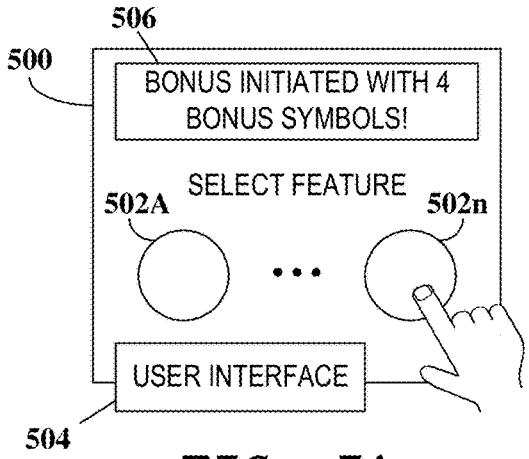
FIGS. 5A-5L illustrate a succession of stages of a representative slot game depicting a representative manner for facilitating participation in an award-generating feature involving successive player selection of groups of payout-related gaming characteristics to obtain awards and extend a payout modifier or enhancement state.
Figure 5B:
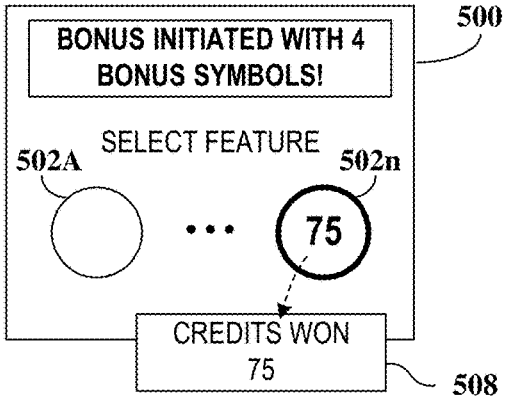
Figure 5C:
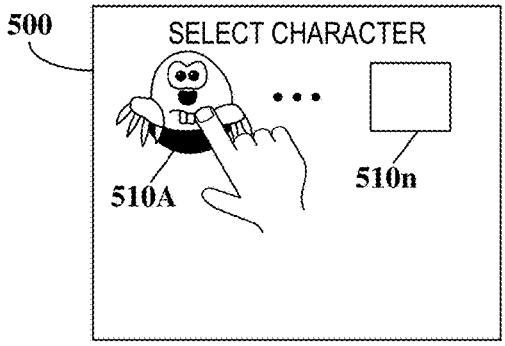

Referring first to FIG. 5A, a first presentation may be provided via the display 500 in response to being awarded the bonus event or other gaming feature. In one embodiment, the player is provided with a selectable option to pick at least one of a plurality of available bonus events or other gaming features 502A-502*n*, which may be accomplished by way of any user interface 504, whether electronic, mechanical, touchscreen, etc. Notifications may also be provided, such as a notice 506 indicating the number of symbols (or other criteria) that occurred to initiate the bonus event, where such number may have an impact on playing and/or initializing the gaming feature to be played. For example, in one embodiment, the number of bonus symbols occurring to initiate the bonus event also impacts an initial state of at least one of the payout-related gaming characteristics used in the feature. With this optional step, the player may select one of the available gaming features, such as gaming feature 502*n* shown in FIG. 5B where a bonus event in accordance with the teachings herein is selected. In one embodiment, a credit value or other award may be provided in connection with selecting a bonus event, or may just be provided as a result of gaining entry to the bonus event or other feature. In the illustrated embodiment, the display 500 may also provide a credit win indication 508 as to the running total of the credits (and/or other player assets) won during this gaming activity. Since the player won 75 credits in this example, the credit win indication 508 shows a running total of 75 credits.

Figure 5D:
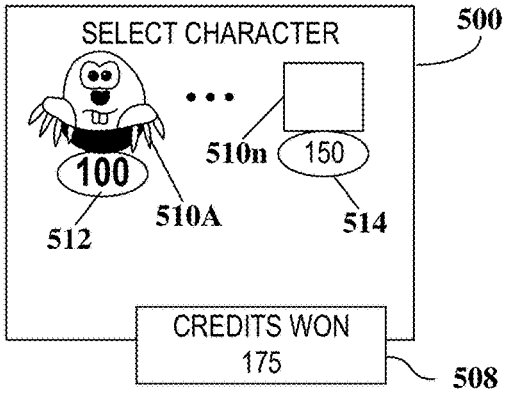

In one embodiment, the gaming system may allow the player to select one or more other items, whether to provide additional credit awards, select a character for participation in the feature, etc. In the embodiment shown in FIG. 5C, a plurality of characters 510A-510*n* are presented to the player for selection, where a selected character is used in a themed bonus event or gaming feature, and another credit award (and/or other player assets) may again be provided. FIG. 5D depicts a player's selection of a character 510A, thereby receiving a hidden credit value of 100 credits 512, which may be added to the running credit total depicted by the credit win indication 508. The unselected character 510*n*'s credit value 514 may be displayed, as an indication of what the player might have been awarded had the player selected that character. The credit values assigned to the characters 510A-510*n* may be chosen in any manner, including by weighted random draw without replacement from a table, and in some embodiments multiplied by 1, 2, 3, or 4 (or whatever desired values) if initiated with 3, 4, 5, or 6 (or however many desired) scattered bonus initiation symbols respectively, and in still further embodiments by the bet-per-line on the initiating spin. When the player chooses a character, the corresponding hidden credit value is awarded. Selection of bonus events, and characters, as described in connection with FIGS. 5A-5D merely represent optional aspects of gaming features described herein.

Figure 5E:
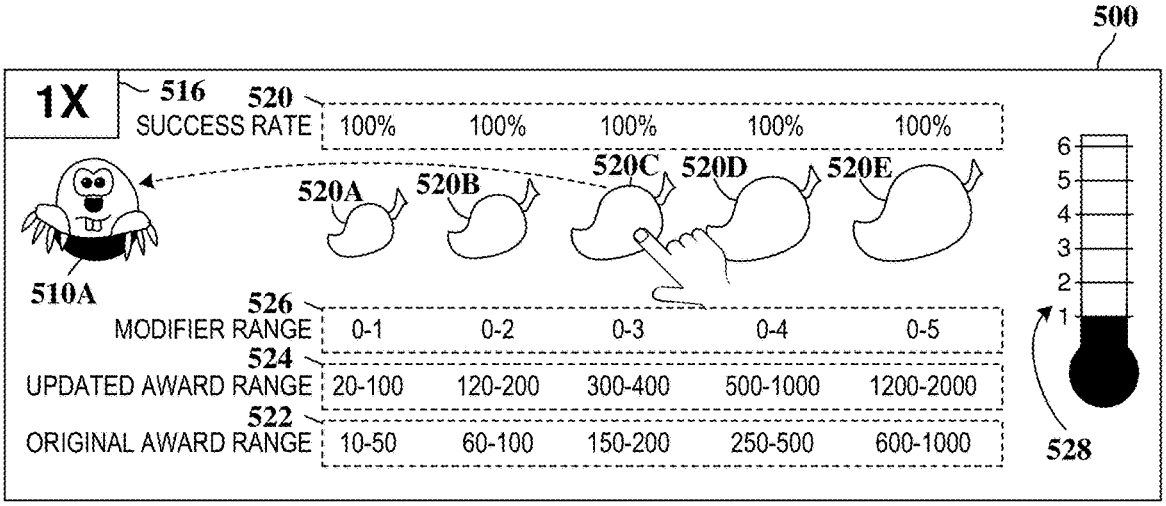

FIG. 5E depicts one representative presentation of a gaming feature involving risk-assessable selections of groups of payout-related gaming characteristics as described herein. The display 500 may present information such as, for example, a selected character 510A if such selection is made available in the feature, and an initial multiplier (or other modifier(s)) shown at current multiplier display area 516. A plurality of player-selectable items may be presented in one embodiment, such as items 520A, 520B, 520C, 520D and 520E. In one embodiment, the selectable items may be themed in accordance with the gaming feature, such as providing a plurality of increasing size hot peppers. The "theme" may relate to the ultimate termination of the gaming feature, such as when the player has made selections of the groups of payout-related gaming characteristics (e.g., credit/modifier groups) that correspond to different pepper spice levels that then relate to the threshold condition that can end the gaming feature, such as when the pepper spice intake by the character 510A becomes too spicy or hot, the gaming feature will end. Such themes are of course optional, and are described herein as an example of implementing the player-selectable groups of payout-related gaming characteristics described herein.

As shown in FIG. 5E, an original award range 522 provides a plurality of credit ranges (or other player asset ranges) originally available to the player as a result of being awarded a bonus event or gaming feature, or in other embodiments in connection with a primary game. In one embodiment, the original credit ranges 522 may initially be increased or otherwise enhanced as a result of other gameplay characteristics, such as the number of bonus symbols occurring to enter the bonus event, as was depicted at notification 506 of FIG. 5A. In the illustrated embodiment of FIG. 5E, it is assumed that some gameplay characteristics were met to provide an updated award range 524, which in the illustrated embodiment has doubled the credit ranges for each of the selectable items 520A, 520B, 520C, 520D and 520E (i.e. from 10-50 to 20-100 for selectable item 520A, from 60-100 to 120-200 for selectable item 520B, etc.).

As previously noted, one embodiment involves providing multiple payout-related gaming characteristics into sets or groups that can be selected by the player, and which may be based on relative risks of ending the gaming feature where awards can no longer be obtained in connection with that particular event or feature. In the example of FIG. 5E, the payout-related characteristic that is grouped with credit ranges 524 are modifier ranges 526, such as multiplier ranges. In a more particular embodiment, as in the present example of FIGS. 5E-5L, the modifier range 526 represents a plurality of multiplier advancement ranges where a random system-selected multiplier advancement from within the player-selected modifier range 526 (due to selection of one of the selectable items 520A, 520B, 520C, 520D, 520E) is added to a current multiplier level to increase multipliers for payout enhancement, with the risk of the current multiplier level exceeding a threshold and thereby ending the gaming feature. The current multiplier level and/or threshold may be depicted in any desired manner, including numerically, visually, graphically, etc. In the illustrated embodiment, the vehicle to present the current multiplier level 528 and threshold level is a graphical thermometer, where each level (levels 1-6 in this example) represents a multiplier level, and the threshold is anything over the top value (anything over 6 in this example). Thus, as the player makes selections among the selectable items 520A, 520B, 520C, 520D and 520E, a randomly selected multiplier advancement is selected from the multiplier advancement range 526 associated with the selectable item chosen by the player. As the multiplier advancement for player selections of the selectable items continues, the current multiplier level 528 increases to the benefit of the player (as higher multipliers better enhance credit values relative to lower multipliers), yet the risk of exceeding the multiplier threshold lurks as new multiplier advancements are added, which can end the gaming feature and further awards.

The current multiplier level 528 may be implemented as a cumulative storage or other recorder of increasing multipliers or other modifiers. A multiplier aggregation storage may be implemented to provide the current multiplier level 528, and may be implemented, for example, as a software module operable using a processor(s), or may be implanted in other analogous hardware.

Each selectable item 520A, 520B, 520C, 520D, 520E (collectively referred to herein as selectable items 520) is also associated with a corresponding success rate 520. This success rate 520 represents the likelihood that the player will be able to continue participating in the gaming feature after selection of the corresponding selectable item 520A, 520B, 520C, 520D, 520E, based on whether the randomly-identified multiplier advancement from the selected multiplier advancement range 526 could cause the threshold to be reached when added to the current multiplier level 528. For example, the current multiplier level 528 (also depicted at current multiplier display area 516 in the instant example) is at 1×, meaning that awards would currently be multiplied by one. This, in the example of FIG. 5E, it is assumed that the initial modifier is set to 1× as depicted at current multiplier display area 516 and current multiplier level 528, although it may be set to any initial value.

In this example, the player has selected item 520C, which is associated with a group of payout-related gaming characteristics, namely an award range 524 and a multiplier (modifier) range 526 that is 300-400 and 0-3 respectively in the present example. Thus, by selecting selectable item 520C, the player can obtain an award between 300 and 400 credits, and a multiplier advancement between 0 and 3. The player, when making such a decision as to which selectable item to select, can see that greater potential credit awards are associated with greater potential modifier advancements, both of which are good, unless the randomly selected multiplier advancement from the selected multiplier advancement range causes the current multiplier level 528 to exceed the threshold and thereby and the gaming feature.

In the present example, based on the modifier range 526 corresponding to each of the respective selectable items 520, there may be a chance that the threshold of the current multiplier level 528 is exceeded, thereby causing the current gaming feature (and further awards and/or enhanced awards) to end. These "chances" for each selectable item 520A, 520B, 520C, 520D, 520E is depicted as its success rate 520. When the current multiplier level 528 is low, it is possible that all selections may have a 100% success rate, as is the case for the player's first selection in the example of FIG. 5E. As will be seen, as the current multiplier level 528 increases with player selections of selectable items 520, the success rates of one, more, or all of the selectable items 520 may decrease. This is because the possibility that a randomly-selected multiplier advancement from the modifier range 526 of the player-selected selectable item 520 is more likely to cause the threshold to be reached the larger the current multiplier level 528 is.

Figure 5F:
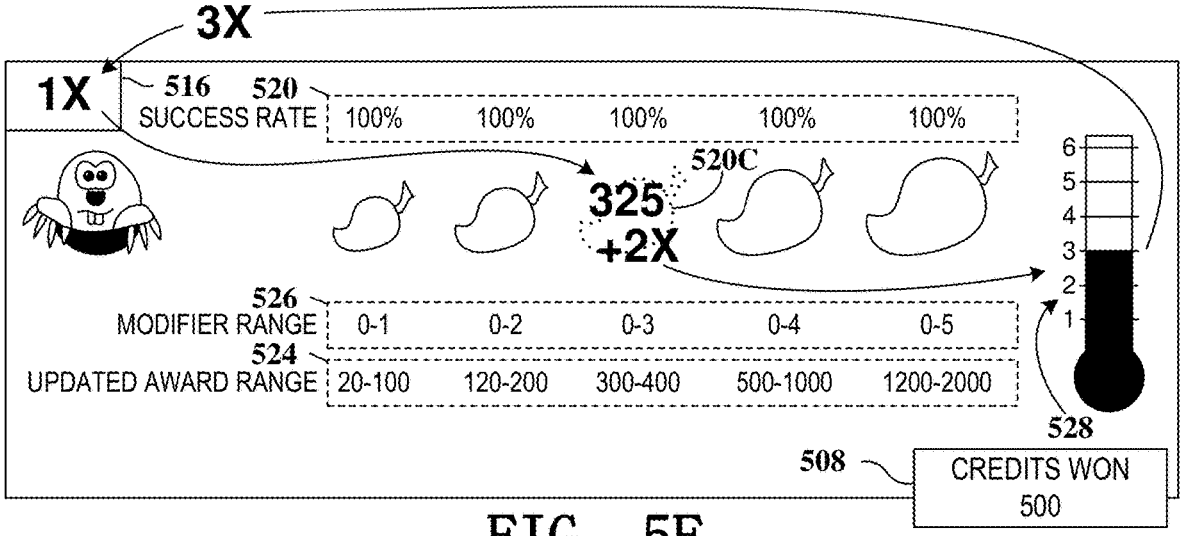

Thus, for the example of FIG. 5E, the player has selected selectable item 520C, thereby selecting the payout-related gaming characteristics of a modifier range 526 of 0-3 multiplier advancement and 300-400 credits. Turning now to FIG. 5F, the result of the player's selection is a randomly-selected credit value and multiplier advancement value from the respective award range 524 and modifier range 526. In this example, as seen as selected item 520C, the player was randomly awarded a credit award of 325 credits (within the selected range 524 of 300-400 credits) and a multiplier advancement of +2× (with the selected range 526 of 0-3). Thus, the player has won 325 credits, and the current multiplier level 528 will be increased by two for next credit award on the next selection (if any).

In one embodiment, the currently awarded credit value, 325 credits in this example, is multiplied by the current multiplier level 528 before the multiplier advancement is applied. In other embodiments, the current multiplier level 528 may be updated by the multiplier advancement before being applied to the most recent credit award. In the present example, the current multiplier level 528, also depicted as 1× at current multiplier display area 516, is multiplied by the awarded credit value of 325. This total of 325 credits may be added to the running credit total displayed at credit value indication 508, which is now 500 credits. The +2× multiplier that was randomly awarded as a result of the player's selection of selectable item 520C (and modifier range 526 of 0-3 for a multiplier advancement) is added to the current multiplier level 528 to now be set to a 3× multiplier, which is also reflected in this embodiment in the credit win indicator 516. Therefore, player selection will be multiplied by the new 3× multiplier.

Figure 5G:
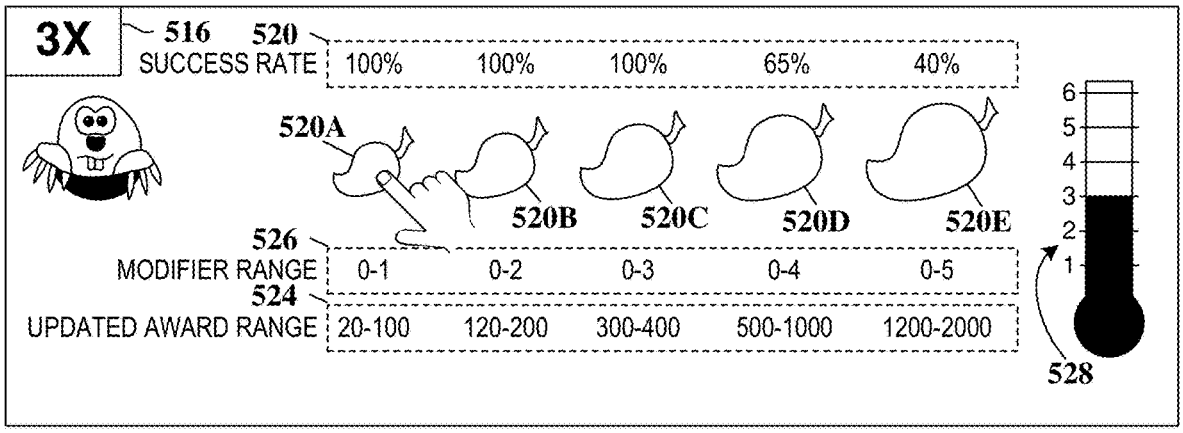

FIG. 5G shows the players next selection, which is authorized since the threshold has not yet been reached, and the game feature may therefore continue. As can be seen, the success rates 520 have changed somewhat, in view of the current multiplier level 528 having increased from 1× to 3×. For example, in this embodiment, the threshold is anything greater than 6 in the current multiplier level 528. The current level is at 3×, so only an additional multiplier advancement of 3 or less will keep the feature going—else the feature will end. Since the multiplier advancement ranges for selectable items 520A, 520B and 520C will result in a selected multiplier advancement value of three or less, any randomly selected value will not cause the current multiplier level 528 to reach the threshold for terminating the gaming feature. Therefore, the success rates 520 for these three selectable items 520A, 520B and 520C remain at 100%.

On the other hand, the multiplier advancement range 526 for selectable item 520D will be in the range of 0-4, so if the randomly-selected value was 4, the total in the current multiplier level 528 would reach greater than the threshold value of 6 (e.g., current multiplier of 3 plus new value of 4 is greater than 6), and the gaming feature would be terminated. Thus, the success rate for selecting item 520D must be less than 100%, since there is one potential value (4) that will terminate the gaming feature.

Similarly, for selectable item 520E, the multiplier advancement range 526 is 0-5, and therefore either a randomly-selected value of 4 or 5 would cause the threshold value of 6 to be exceeded (e.g., current multiplier of 3 plus new value of 4 or 5 is greater than 6). Thus, the success rate for selecting item 520E must be less than 100%, and less than that of item 520D, since there are two one potential values (4 and 5) that will terminate the gaming feature. The success rates 520 are accordingly updated in this manner.

The calculation of the respective success rates may be based on additional gaming characteristics other than only the number of modifier values that will and won't result in success, such as the possible credit values also associated with those respective selections.

At the stage of FIG. 5G, the player has this time selected selectable item 520A, which will produce a randomly-selected credit award within the range 524 of 20-100, and a randomly-selected multiplier within the range 526 of 0-1. Because either a 0 or 1 as a received multiplier advancement would not cause the current multiplier level 528 to exceed the threshold of 6, the chances of continued play after selecting item 520A are 100% as denoted by the respective success rate 520. However, to obtain such low risk the player gave up the opportunity to obtain a higher credit award with selectable items associated with higher award ranges 524.

Figure 5H:
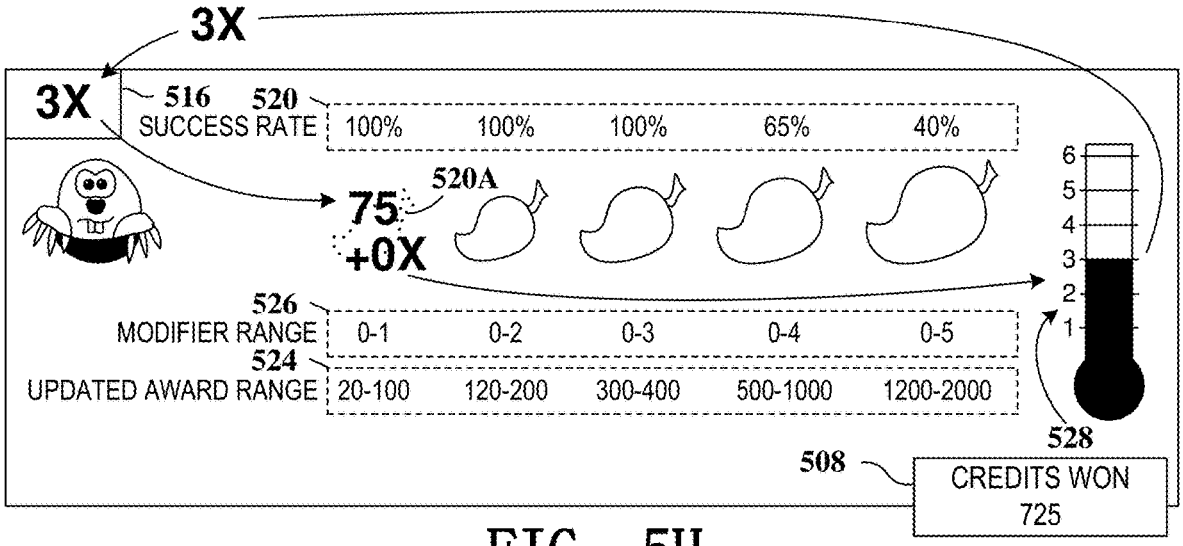

After selection, the system randomly selects a credit award and multiplier from the award range 524 and modifier range 526 associated with the selected item 520A. This is depicted at FIG. 5H, where the resulting awarded credit value is 75 credits, and the awarded multiplier advancement is zero, meaning the current multiplier level 528 will not be increased. The credits won is updated to 725 credits in the credit win indicator 508, and no further action is taken with respect to the current multiplier level 528 since there was no multiplier advancement on the selection.

Figure 5I:
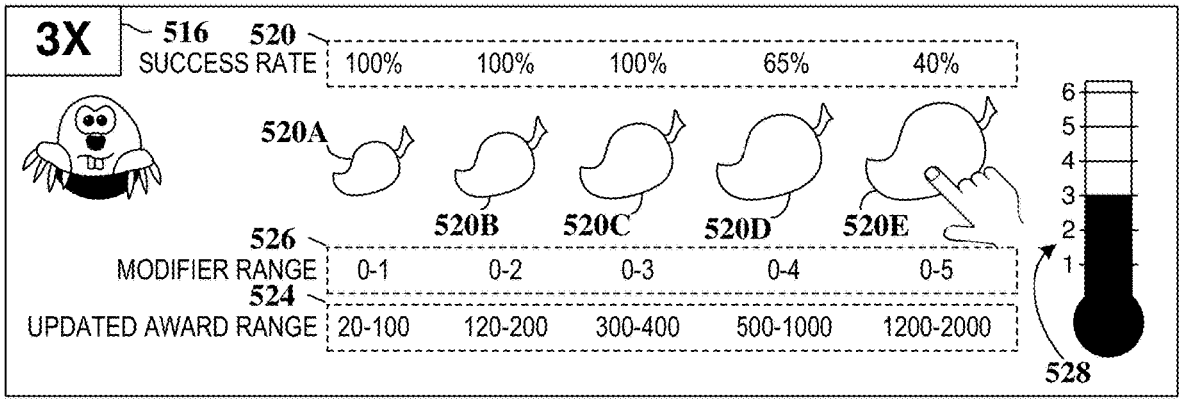

At the stage of FIG. 5I, the player has this time selected selectable item 520E, which will produce a randomly-selected credit award within the range 524 of 1200-2000, and a randomly-selected multiplier within the range 526 of 0-5. Because either a 4 or 5 as a received multiplier advancement will cause the current multiplier level 528 to exceed the threshold of 6, the chances of continued play are less 100% as denoted by the respective success rate 520. However, to obtain the chance of getting such a high credit award (in the range of 1200-2000), the player is willing to risk ending the gaming feature. If the randomly-selected multiplier advancement is three or less, however, the game feature will be allowed to continue since the threshold will not have been exceeded.

Figure 5J:
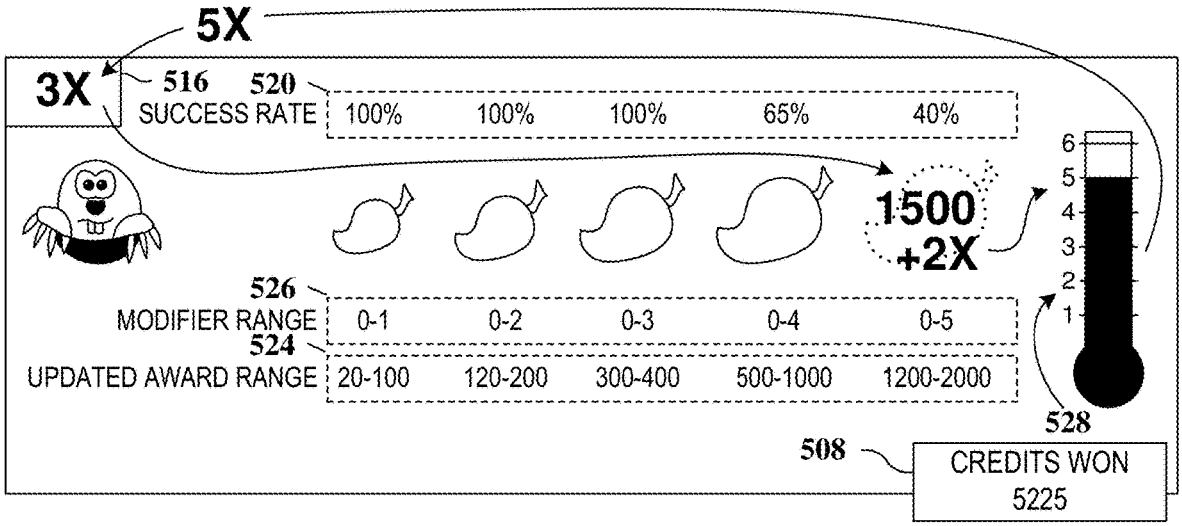

After selection, the system randomly selects a credit award and multiplier from the award range 524 and modifier range 526 associated with the selected item 520E. This is depicted at FIG. 5J, where the resulting awarded credit value is 1500 credits, and the awarded multiplier advancement is 2×, meaning the current multiplier level 528 will be increased by 2×, after the current multiplier value (3×) is applied to the 1500 credit award. The 3× value times the awarded credit value of 1500 results in a 4500 credit award, which is added to the running total (now a running total of 5225 credits) and displayed at the credit win indicator 508. The current multiplier level 528 is then updated, i.e. raised to 5 since a +2× multiplier advancement is added to the 3× multiplier level, and the current multiplier display area 516 may also be updated to reflect the new current multiplier level.

Figure 5K:
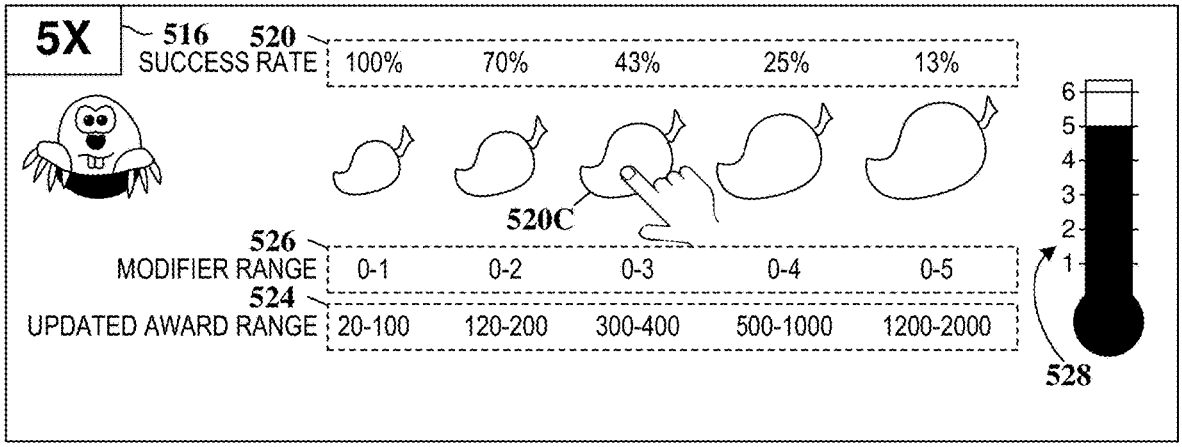
Figure 5L:
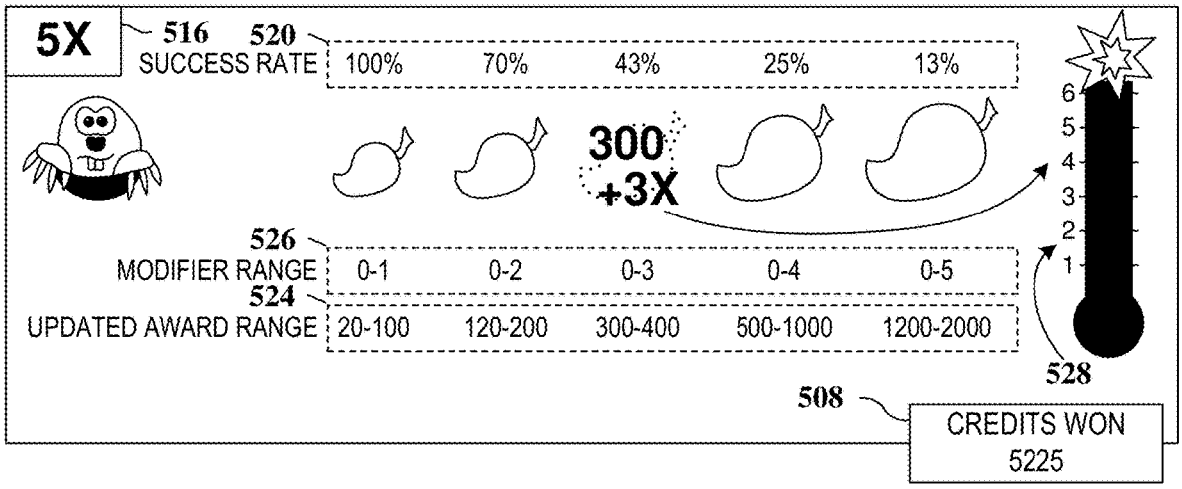

At the stage of FIG. 5K, the player has this time selected selectable item 520C, which will produce a randomly-selected credit award within the range 524 of 300-400, and a randomly-selected multiplier within the range 526 of 0-3. Because either a 2 or 3 as a received multiplier advancement will cause the current multiplier level 528 to exceed the threshold of 6, the chances of continued play are less 100% as denoted by the respective success rate 520. In response to the selection, a 300 credit award, and +3× multiplier advancement were randomly identified from their respective award range 524 and modifier range 526. Because the +3× multiplier advancement causes the current multiplier level 528 to exceed its threshold of six (i.e. 5×+3× is greater than the threshold of 6×), the gaming feature ends. In one embodiment, the awarded credit value of 300 credits may still be awarded, and/or may be awarded after enhancement by the preselection multiplier level of 5×. In another embodiment, once the threshold has been exceeded, any awarded credit value, enhanced or not, is not awarded. In the example of FIG. 5L, the awarded 300 credits is not provided, and the player ends the gaming feature having won 5225 credits as depicted in the credit win indicator 508.

It should be noted that any one or more gaming characteristics could be used toward a threshold value. For example, the range of credits, and the use of a running total of credits, could instead or additionally be used. In other words, where the example of FIGS. 5A-5L used the randomly-selected multiplier advancements and a current multiplier level as the basis for establishing and monitoring for a threshold crossing, an analogous threshold could be made from credit awards, as the player selects a credit range 524 and there would be a chance of the randomly-identified credit award from the player-selected range of credits exceeding the threshold. Thus, the success rate 520 could also be modified to accommodate a credit threshold versus a multiplier or other modifier threshold. Also, both a modifier and credit value could be used as a threshold, where both need to exceed their respective thresholds, or where either needs to exceed its respective threshold, etc. Other gaming characteristics can additionally or instead be used to create the same type of success rate 520 and threshold.

Figure 6:
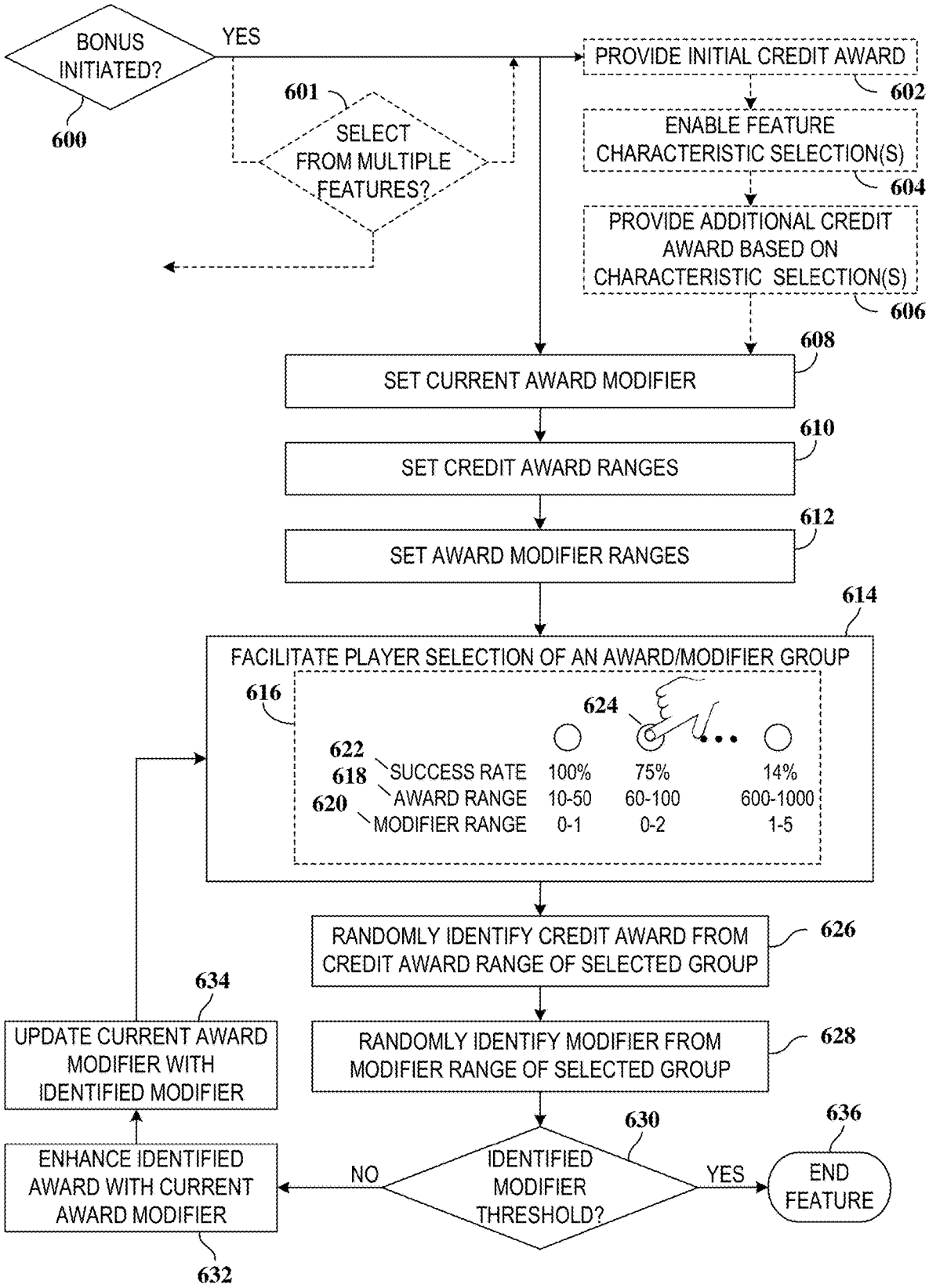
FIG. 6 is a flow diagram illustrating an embodiment of selectable credit/multiplier pairings within independent credit and multiplier ranges.

FIG. 6 is a flow diagram illustrating an embodiment of selectable credit/multiplier pairings within independent credit and multiplier ranges. The example of FIG. 6 is provided for purposes of example only, as many variations from the example of FIG. 6 are available in view of the teachings herein.

In one embodiment, it may first be determined 600 whether a bonus event or other gaming feature has been initiated. As previously noted, the principles described herein are applicable to primary wagering games, bonus games, auxiliary games, or any type of game, although the example of FIG. 6 is described in connection with a slot game that provides bonus events that facilitate the player's selection of groups of payout-related gaming characteristics with feature termination risk analysis. In one embodiment, the player may be allowed to select this particular bonus event from a plurality of bonus events, as identified at block 601. In one embodiment, the player may be provided 602 with an initial credit award in connection with initiation of the bonus event. In one embodiment, feature characteristic selections may be enabled 604, such as selecting a character, item, theme, or other aspects associated with the bonus event to be played. In one embodiment, additional credit awards based on such characteristic selections may be provided 606.

An initial award modifier, such as an initial multiplier, may be set 608. The initial award modifier represents a first state of the modifier to be applied to awarded credits. It may be set to a desired initial number or any desired modification factor, whether used for multiplication, addition, exponentiation, etc.

Credit award ranges may also be set 610, which may be fixed ranges, random ranges, or may be based on the bonus initiation status (e.g., the number of symbols arising that initiated the bonus, a special symbol(s), etc.), or the like. In one embodiment, the higher the number of bonus symbols that generated the bonus event, the higher the selectable credit ranges will be.

Award modifier ranges may also be set 612, which may be fixed ranges, random ranges, or also may be based on the bonus initiation status or some other criteria. In one embodiment, the modifier ranges pertain to the amount that modifiers can be increased from a prior modifier value—e.g., ranges of multiplier advancement values. The ranges may be fixed, in that they are the same each time a bonus event is awarded, while the ranges themselves may differ from one another for each of the selectable groups of payout-related gaming characteristics. For example, a first "fixed" multiplier advancement range could be 0×-1×, meaning the randomly-selected multiplier for this group, if selected, would be selected from the possibilities of adding 0× or 1× to the current multiplier level; a second fixed multiplier advancement range could be 0×-2×, meaning the randomly-selected multiplier for this group, if selected, would be selected from the possibilities of adding 0×, 1×, or 2× to the current multiplier level; a third fixed multiplier advancement range could be 0×-3×, meaning the randomly-selected multiplier for this group, if selected, would be selected from the possibilities of adding 0×, 1×, 2×, or 3× to the current multiplier level; a fourth fixed multiplier advancement range could be 0×-4×, meaning the randomly-selected multiplier for this group, if selected, would be selected from the possibilities of adding 0×, 1×, 2×, 3×, or 4× to the current multiplier level, and so forth. In other embodiments, the ranges need not be fixed, but could be randomly selected between some boundaries, while allowing different selectable groups to have different boundaries if desired.

Based on the established groupings of credit award ranges and award modifier ranges, the gaming system facilitates 614 player selection of an award/modifier group. A portion of a display 616 may present the various groupings to the player, such as groups of an award range 618 and modifier range 620, which may further be associated with a respective success rate 622 of continued participation in the gaming feature based on the selection. In the illustrated embodiment, the player has selected a group associated with user input 624, that has a credit award range 618 of 60-100 credits, a modifier range 620 of 0-2, and a resulting success rate 622 of 75%.

In response to the selection, the gaming system randomly identifies 626 a credit award within the credit award range of the group selected by the player, and identified 628 a modifier within the modifier range of the group selected by the player. If this choice did not cause a threshold to be met (e.g., the identified 628 modifier causing an accumulated modifier to reach/exceed a threshold), then the identified award is enhanced 632 or otherwise modified with the current award modifier (which in one embodiment is an accumulated modifier before adding the randomly identified 628 modifier from the current selection). The current award modifier is then updated 634 with the identified modifier, and the system facilitates 614 another selection of an award/modifier group by the player. This may continue until the modifier threshold is identified 630 to be reached, whereby the feature ends 636.

Figure 7A:
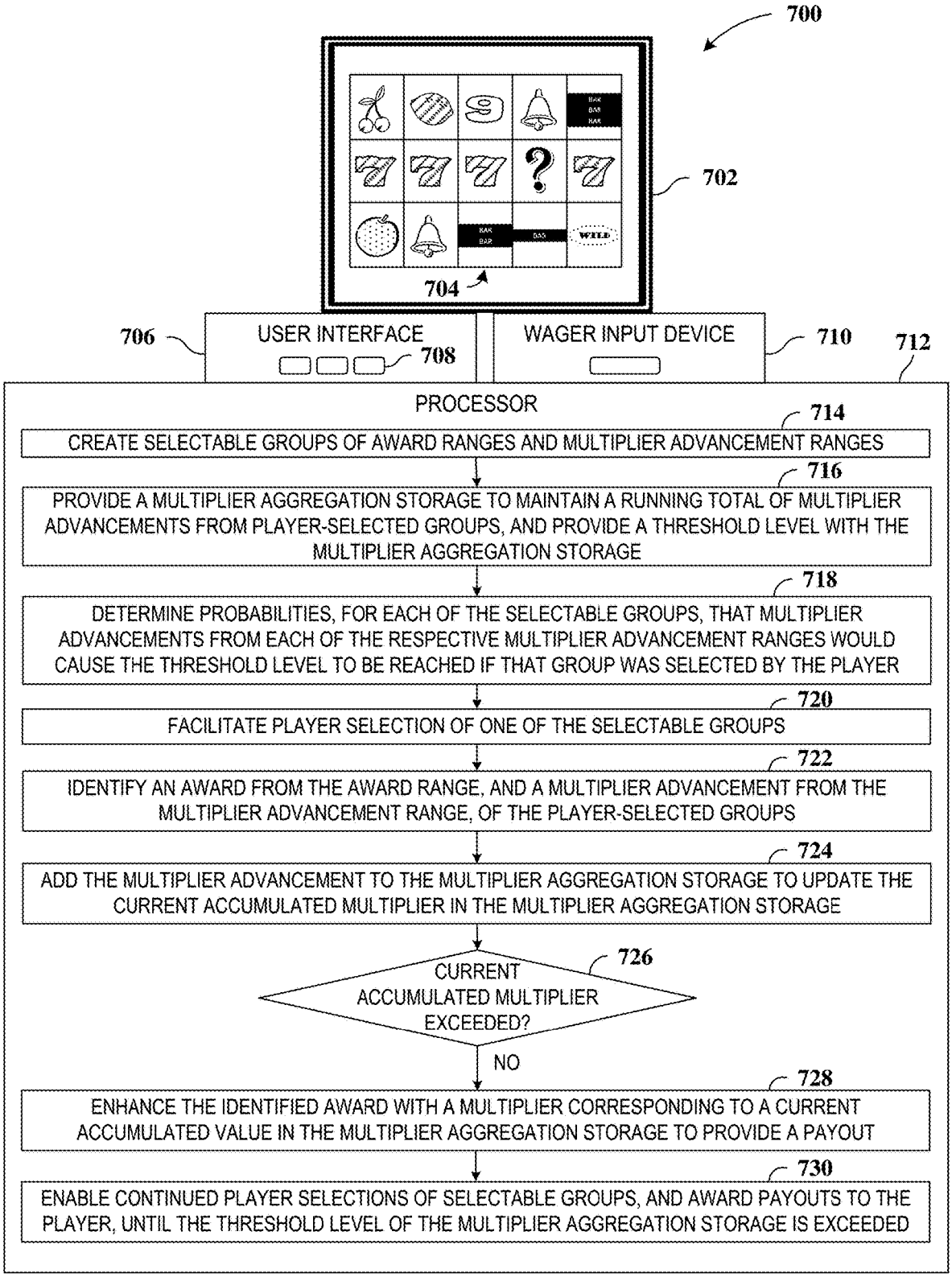
FIGS. 7A and 7B are block diagrams of representative gaming apparatuses providing player-selectable groups of gaming characteristics having various award and modifier ranges in each group and corresponding to respective success rates for further participation in the gaming activity.
Figure 7B:
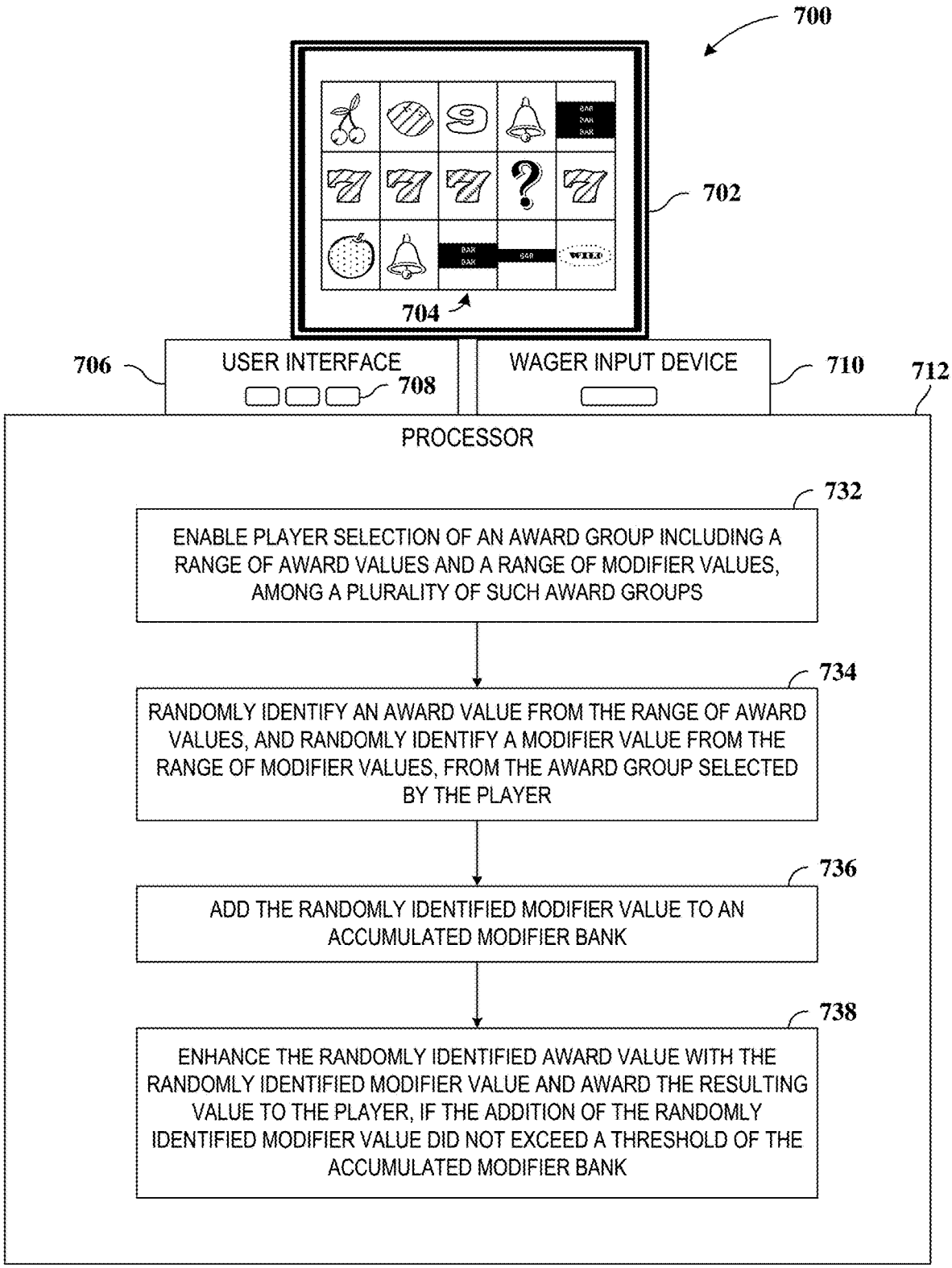

FIGS. 7A and 7B are block diagrams of representative gaming apparatuses providing player-selectable groups of gaming characteristics having various award and modifier ranges in each group and corresponding to respective success rates for further participation in the gaming activity.

In the embodiment of FIG. 7A, a slot game device 700 is provided on which players can play slot games. Other games may instead be used as a primary game, such as poker, etc. The representative slot game device 700 includes at least a display 702 presenting a slot game symbol array or "grid" 704 of symbol locations, a user interface 706 including at least one user input 708 to enable a player to initiate a slot game event presented via the slot game grid 704, and a wager input device 710 structured to identify and validate player assets and ultimately permit the player to play the slot game event when the player assets are provided. The slot game device 700 also includes a processor 712 configured to create 714 a plurality of selectable groups, each comprising an award range and a multiplier advancement range. The processor 712 is also configured to provide 716 a multiplier aggregation storage to maintain a running total of multiplier advancements from player-selected ones of the selectable groups, and provide a threshold level with the multiplier aggregation storage. In one embodiment, the processor 712 determines 718 probabilities, for each of the selectable groups, that multiplier advancements from each of the respective multiplier advancement ranges would cause the threshold level to be reached if the respective one of the selectable groups was selected by the player. The processor 712 also facilitates 720 player selection of one of the selectable groups, identifies 722 an award from the award range, and a multiplier advancement from the multiplier advancement range, of the player-selected one of the selectable groups. The processor 712 adds 724 the multiplier advancement to the multiplier aggregation storage to update the multiplier aggregation storage. If the current accumulated multiplier has not been exceeded as determined at block 726, the processor 712 enhances 728 the identified award with a multiplier corresponding to a current accumulated value in the multiplier aggregation storage to provide a payout, and award the payout to the player, and enables 730 continued player selections of one of the selectable groups, and award the payouts to the player, until the threshold level of the multiplier aggregation storage is exceeded.

The slot game device 700 configures the processor 712 (which may include one or more cooperative processing devices) to structurally program functional elements into hardware modules. Processor 712 circuitry configuration thus changes based on the modules developed by software to carry out the desired methodology. For example, the processor 712 is programmed by software/code to create a hardware-based module to create the selectable groups 714 and to create other such software/code modules for each of the operations 714-730. Other structural modules may be created on the slot game device using a properly configured processor 712. Referring now to the example of FIG. 7B, the processor 712 may be configured into programmed modules to enable 732 player selection of an award group including a range of award values and a range of modifier values, among a plurality of such award groups, and, from the award group selected by the player, to randomly identify 734 an award value from the range of award values and a modifier value from the range of modifier values. The processor in this embodiment is configured to add 736 the randomly identified modifier value to an accumulated modifier bank, and enhance 738 the randomly identified award value with the randomly identified modifier value and award the resulting value to the player, if the addition of the randomly identified modifier value did not exceed a threshold of the accumulated modifier bank.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A game apparatus for enhancing gaming awards in a gaming activity, comprising:

a display;

a user interface including at least one user input to enable a player to initiate the gaming activity and to participate in a bonus event;

a wager input device structured to identify and validate player assets, and to permit the player to play bonus event when the player assets are provided; and a processor configured to:

(a) enable player selection of an award group including a range of award values and a range of modifier values, among a plurality of such award groups;

(b) randomly identify an award value from the range of award values, and randomly identify a modifier value from the range of modifier values, from the award group selected by the player;

(c) associate different pairings of the range of award values and the range of modifier values with each of the award groups;

(d) calculate a likelihood of a potential one of the identified modifier values from the range of modifier values;

(e) present an indication of the calculated likelihood to the player via the display;

(f) add the randomly identified modifier value to an accumulated modifier bank; and (g) enhance the randomly identified award value with the randomly identified modifier value and award the resulting value to the player, if the addition of the randomly identified modifier value did not exceed a threshold of the accumulated modifier bank.

2. The game apparatus as in claim 1, wherein the processor is further configured to facilitate player repetition of (a)-(g) until the addition of the randomly identified modifier value exceeds the threshold of the accumulated modifier bank.

3. The game apparatus as in claim 1, wherein the range of modifier values comprises a range of multiplier values, and the randomly identified modifier value comprises a multiplier value, and wherein the processor is configured to enhance the randomly identified award value by multiplying the multiplier value times the randomly identified award value.

4. A slot game apparatus for facilitating participation in a repeatable award-generating segment of a gaming feature, comprising:

a display;

a user interface including at least one user input to enable a player to interact with the gaming feature;

a wager input device structured to identify and validate player assets, and to permit the player to participate in the gaming feature when the player assets are provided; and a processor configured to:

create a plurality of selectable groups, each comprising an award range and an award modifier advancement range;

provide an award modifier level to maintain a running total of award modifier advancements from player-selected ones of the selectable groups, and providing a threshold level with the award modifier level;

determine probabilities, for each of the selectable groups, that award modifier advancements from each of the respective award modifier advancement ranges would cause the threshold level to be reached if the respective one of the selectable groups was selected by the player;

cause the display to present to the player the determined probabilities for each of the selectable groups;

facilitate player selection of one of the selectable groups;

identify an award from the award range, and an award modifier advancement from the award modifier advancement range, of the player-selected one of the selectable groups;

add the award modifier advancement to the award modifier level to update the award modifier level;

if the threshold level of the award modifier level is not exceeded, enhance the identified award with a modifier corresponding to the award modifier level to provide a payout, and award the payout to the player; and enable continued player selections of one of the selectable groups, and award the payouts to the player, until the threshold level of the award modifier level is exceeded.

5. The slot game apparatus as in claim 4, wherein the processor is configured to enable continued player selections of one of the selectable groups and award the payouts to the player, by facilitating the player selection, identifying the award and the award modifier advancement, adding the award modifier advancement to the award modifier to update the award modifier level, enhance the identified award with the modifier, and award the payout to the player, until the threshold level of the award modifier level has been exceeded as a result of adding the award modifier to the award modifier level.

6. The slot game apparatus as in claim 4, wherein the processor is configured to add the award modifier advancement to the award modifier level before the processor enhances the identified award with the modifier corresponding to the award modifier level to provide the payout.

7. The slot game apparatus as in claim 4, wherein the processor is configured to add the award modifier advancement to the award modifier level after the processor enhances the identified award with the modifier corresponding to the award modifier level to provide the payout.

8. The slot game apparatus as in claim 4, wherein the processor is further configured to compare a current award modifier level to the threshold level of the award modifier level to determine if the threshold level of the award modifier is not exceeded.

9. The slot game apparatus as in claim 4, wherein the processor is further configured to:

update the determined probabilities for each of the selectable groups, in response to each selection of one of the selectable groups by the player; and cause the display to present to the player the updated determined probabilities for each of the selectable groups.

10. The slot game apparatus as in claim 4, wherein the award modifier enhancement range comprises a range of multiplier values, the award modifier level comprises a multiplier level, and the identified award modifier advancement of the player-selected one of the selectable groups comprises a multiplier advancement, and wherein the processor is configured to enhance the identified award with the multiplier level to provide the payout if the threshold level of the multiplier level is not exceeded.

11. The slot game apparatus as in claim 4, wherein the award comprises a credit value and the modifier comprises a multiplier, and wherein the processor is configured to:

create the plurality of selectable groups such that each comprises a credit value range and a multiplier advancement range;

provide a multiplier level to maintain a running total of multiplier advancements from player-selected ones of the selectable groups, and providing a threshold level with the multiplier level;

determine probabilities, for each of the selectable groups, that multiplier advancements from each of the respective multiplier advancement ranges would cause the threshold level to be reached if the respective one of the selectable groups was selected by the player;

facilitate player selection of one of the selectable groups;

identify a credit value from the credit value range, and a multiplier advancement from the multiplier advancement range, of the player-selected one of the selectable groups;

add the multiplier advancement to the multiplier level to update the multiplier level;

if the threshold level of the multiplier level is not exceeded, multiply the identified credit value with a multiplier corresponding to the multiplier level to provide a payout, and award the payout to the player; and enable continued player selections of one of the selectable groups, and award the payouts to the player, until the threshold level of the multiplier level is exceeded.

12. A game apparatus for facilitating participation in a repeatable award-generating segment of a gaming feature, comprising:

a display;

a user interface including at least one user input to enable a player to interact with the gaming feature;

a wager input device structured to identify and validate player assets, and to permit the player to participate in the gaming feature when the player assets are provided; and a processor configured to:

create a plurality of selectable groups, each comprising an award range and a multiplier advancement range;

provide a multiplier aggregation storage to maintain a running total of multiplier advancements from player-selected ones of the selectable groups, and provide a threshold level with the multiplier aggregation storage;

determine probabilities, for each of the selectable groups, that multiplier advancements from each of the respective multiplier advancement ranges would cause the threshold level to be reached if the respective one of the selectable groups was selected by the player;

cause the display to present the determined probabilities for each of the selectable groups to the player;

facilitate player selection of one of the selectable groups;

identify an award from the award range, and a multiplier advancement from the multiplier advancement range, of the player-selected one of the selectable groups;

add the multiplier advancement to the multiplier aggregation storage to update the multiplier aggregation storage;

if the threshold level of the multiplier aggregation storage is not exceeded, enhance the identified award with a multiplier corresponding to a current accumulated value in the multiplier aggregation storage to provide a payout, and award the payout to the player; and enable continued player selections of one of the selectable groups, and award the payouts to the player, until the threshold level of the multiplier aggregation storage is exceeded.

* * * * *